US012016382B2

(12) United States Patent
An

(10) Patent No.: US 12,016,382 B2
(45) Date of Patent: Jun. 25, 2024

(54) AEROSOL GENERATING DEVICE

(71) Applicant: KT&G CORPORATION, Daejeon (KR)

(72) Inventor: Hwi Kyeong An, Seoul (KR)

(73) Assignee: KT&G CORPORATION, Daejeon (KR)

( * ) Notice: Subject to any disclaimer, the term of this patent is extended or adjusted under 35 U.S.C. 154(b) by 569 days.

(21) Appl. No.: 17/285,734

(22) PCT Filed: Nov. 19, 2020

(86) PCT No.: PCT/KR2020/016380
§ 371 (c)(1),
(2) Date: Apr. 15, 2021

(87) PCT Pub. No.: WO2021/101272
PCT Pub. Date: May 27, 2021

(65) Prior Publication Data

US 2022/0361569 A1 Nov. 17, 2022

(30) Foreign Application Priority Data

Nov. 22, 2019 (KR) ..... 10-2019-0151616

(51) Int. Cl.
*A24F 40/40* (2020.01)
*A24F 40/50* (2020.01)

(52) U.S. Cl.
CPC ..... *A24F 40/40* (2020.01); *A24F 40/50* (2020.01)

(58) Field of Classification Search
CPC ..... A24F 40/00; A24F 40/40; A24F 40/42; A24F 40/46; A24F 40/465; A24F 40/50; A24F 40/51; A24F 40/53; A24F 40/57
USPC ..... 131/329
See application file for complete search history.

(56) References Cited

U.S. PATENT DOCUMENTS

| | | | |
|---|---|---|---|
| 9,913,493 | B2 | 3/2018 | Worm et al. |
| 10,015,992 | B2 | 7/2018 | Li et al. |
| 2012/0285958 | A1 | 11/2012 | Lee |
| 2013/0167854 | A1 | 7/2013 | Shin |
| 2016/0050975 | A1 | 2/2016 | Worm et al. |
| 2017/0202268 | A1 | 7/2017 | Li et al. |
| 2017/0347709 | A1 | 12/2017 | Laakso et al. |

(Continued)

FOREIGN PATENT DOCUMENTS

| | | | |
|---|---|---|---|
| CN | 206692494 | A | 12/2017 |
| CN | 107713019 | A | 2/2018 |

(Continued)

OTHER PUBLICATIONS

Office Action dated Jun. 21, 2022 from the Japanese Patent Office in JP Application No. 2021-525667.

(Continued)

*Primary Examiner* — Khiem M Nguyen
(74) *Attorney, Agent, or Firm* — Sughrue Mion, PLLC

(57) ABSTRACT

An aerosol generating device includes an accommodating portion accommodating an aerosol generating article through an opening formed in an upper housing, a cover portion configured to open and close the opening, and an extracting portion mounted in the accommodating portion, contacting with the aerosol generating article, and configured to extract the aerosol generating article by moving from a first position to a second position in an longitudinal direction of the accommodating portion when the cover portion opens the opening.

12 Claims, 4 Drawing Sheets

(56) References Cited

U.S. PATENT DOCUMENTS

| | | | |
|---|---|---|---|
| 2018/0049472 | A1 | 2/2018 | Mahler et al. |
| 2020/0352231 | A1 | 11/2020 | Han et al. |

FOREIGN PATENT DOCUMENTS

| | | | |
|---|---|---|---|
| CN | 109288130 | A | 2/2019 |
| EP | 2 782 463 | A2 | 10/2014 |
| EP | 3 513 666 | A1 | 7/2019 |
| EP | 3 556 230 | A2 | 10/2019 |
| JP | 11-332544 | A | 12/1999 |
| JP | 2005-65515 | A | 3/2005 |
| JP | 2012-39983 | A | 3/2012 |
| JP | 2017-532009 | A | 11/2017 |
| KR | 10-2012-0124762 | A | 11/2012 |
| KR | 10-2015-0129366 | A | 11/2015 |
| KR | 10-2018-0070436 | A | 6/2018 |
| KR | 10-1874369 | B1 | 7/2018 |
| WO | 2013/076098 | A2 | 5/2013 |
| WO | 2015/174657 | A1 | 11/2015 |

OTHER PUBLICATIONS

Chinese Office Action dated Apr. 21, 2023 in Chinese Application No. 202080006205.4.

International Search Report for PCT/KR2020/016380 dated Feb. 25, 2021 (PCT/ISA/210).

Written Opinion of International Search Report for PCT/KR2020/016380 dated Feb. 25, 2021 (PCT/ISA/237).

Communication dated Apr. 21, 2021, issued by the Korean Intellectual Property Office in application No. 10-2019-0151616.

Office Action dated Oct. 25, 2021 from the Korean Intellectual Property Office in KR Application No. 10-2019-0151616.

Extended European Search Report dated Dec. 13, 2021 from the European Patent Office in EP application No. 20873380.8.

[Fig. 1]
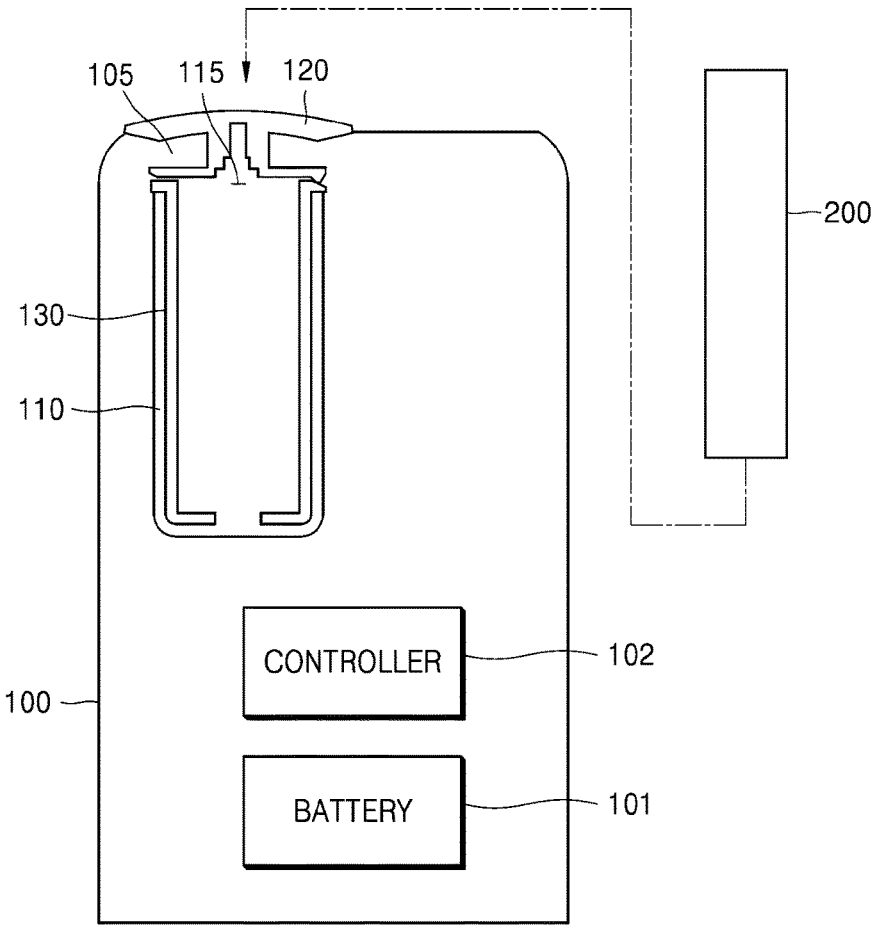
[Fig. 2A]
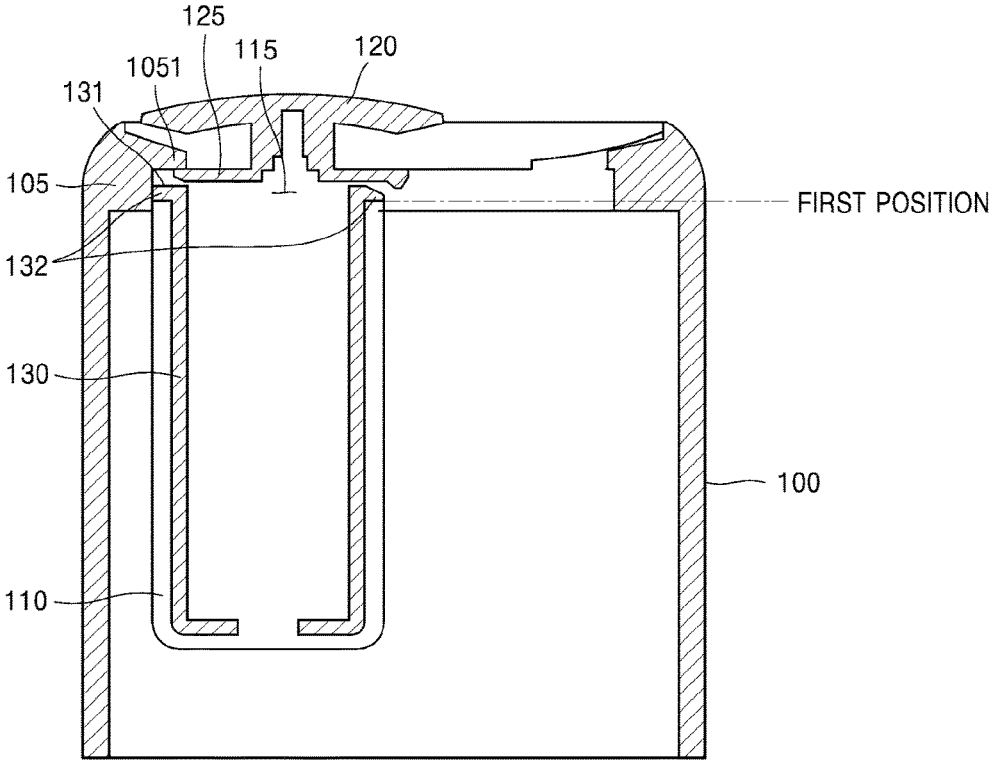

[Fig. 2B]
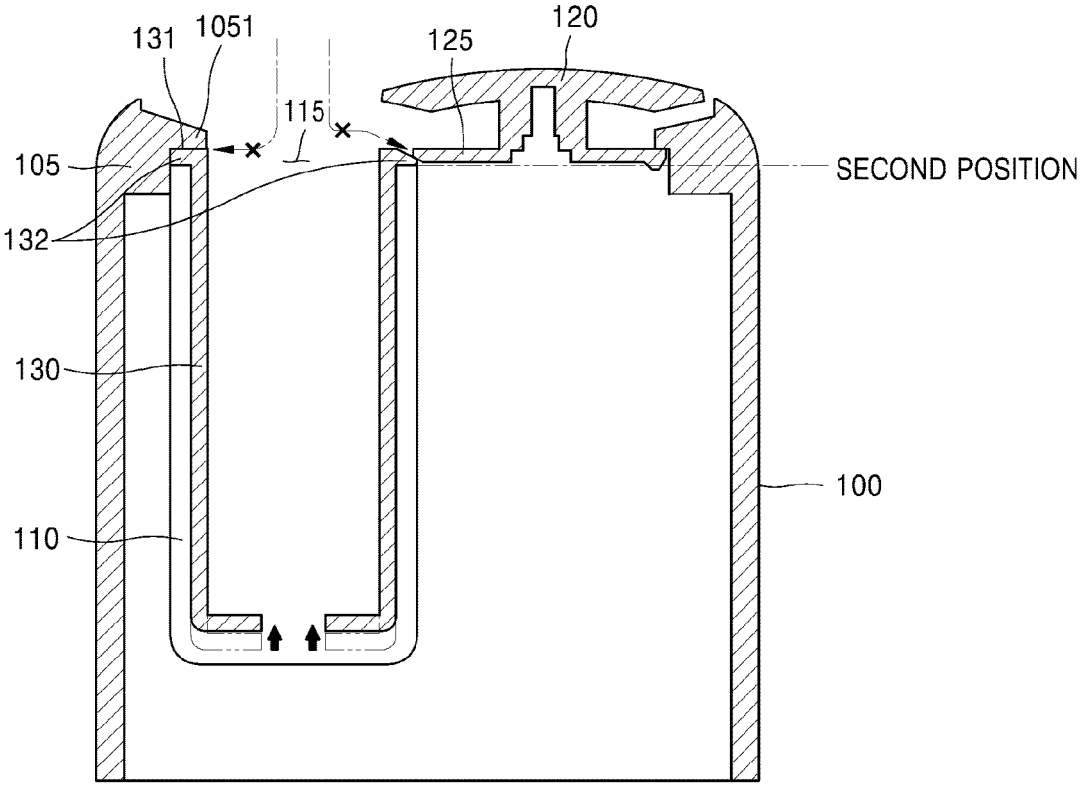
[Fig. 3A]
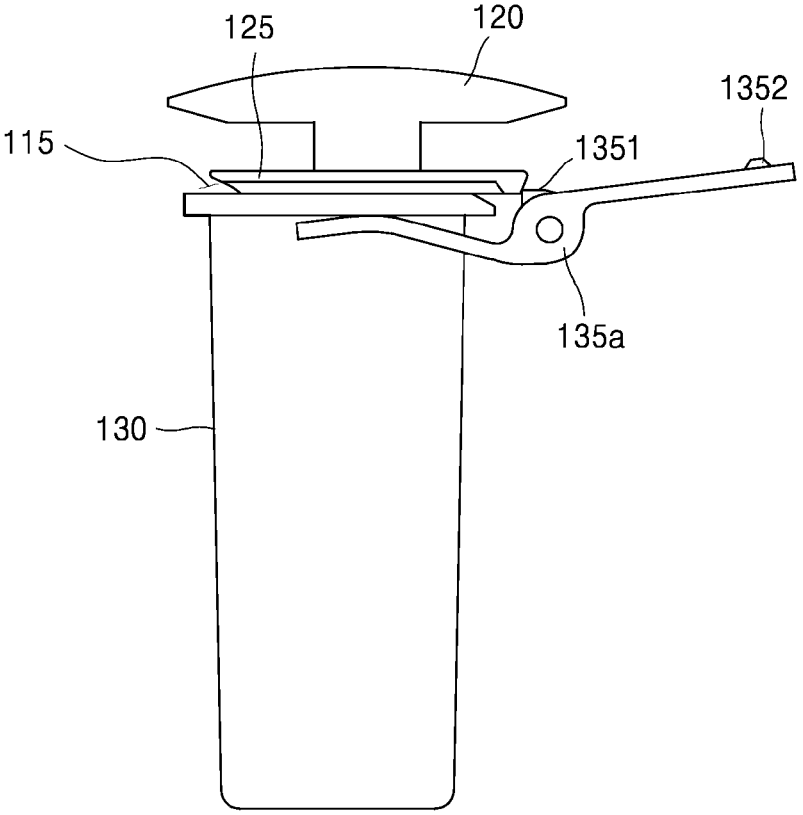

[Fig. 3B]
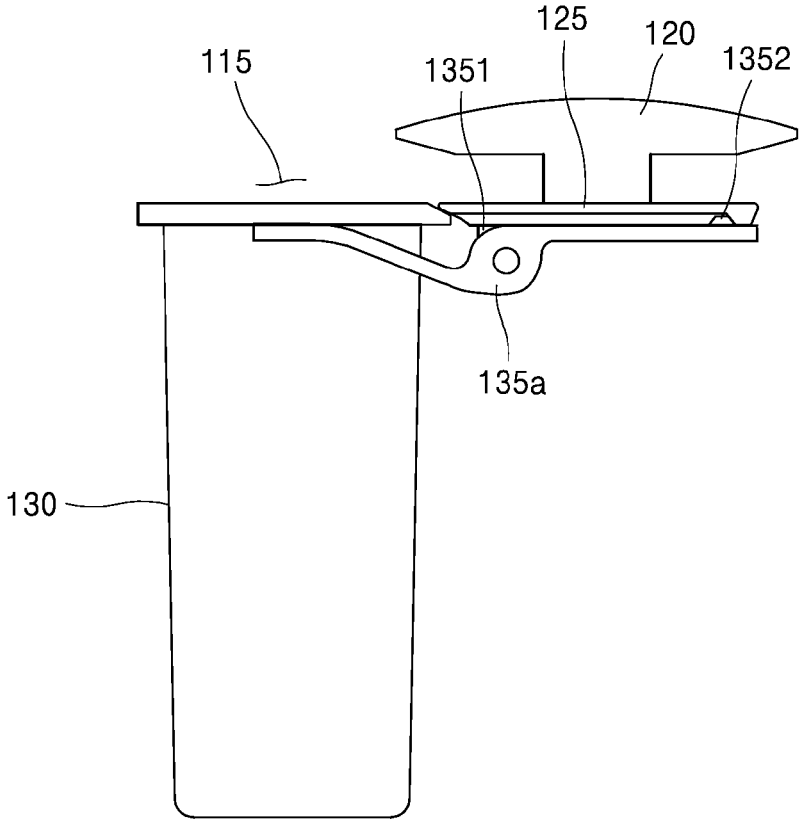
[Fig. 4A]
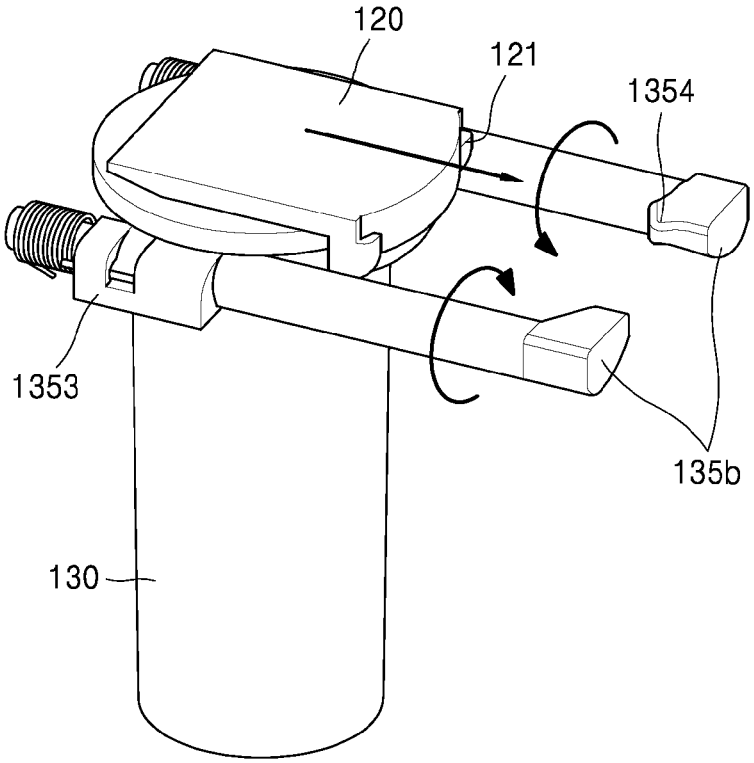

[Fig. 4B]
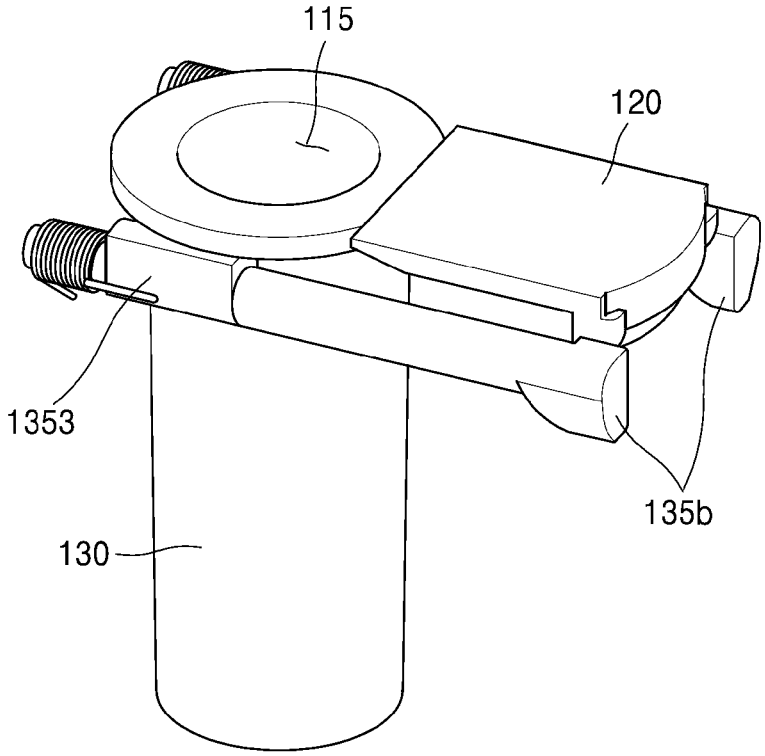

AEROSOL GENERATING DEVICE

CROSS REFERENCE TO RELATED APPLICATIONS

This application is a National Stage of International Application No. PCT/KR2020/016380 filed Nov. 19, 2020, claiming priority from Korean Patent Application No. 10-2019-0151616 filed Nov. 22, 2019.

TECHNICAL FIELD

Embodiments relate to an aerosol generating device including a cover portion and an extracting portion, and more particularly, to an aerosol generating device including an extracting portion that is displaced according to movement of a cover portion.

BACKGROUND ART

Recently, the demand for an alternative to traditional cigarettes has increased. For example, there is growing demand for an aerosol generating device that generates aerosols by heating an aerosol generating material in cigarettes, rather than by combusting cigarettes. Accordingly, research on a heating-type cigarette and a heating-type cartridge is actively being conducted.

DISCLOSURE OF INVENTION

Technical Problem

The aerosol generating device may include an extracting portion configured to easily extract an aerosol generating article accommodated in the aerosol generating device. The aerosol generating article may be inserted into the extracting portion, and the extracting portion may be attached to and detached from an accommodating portion in which the aerosol generating article is accommodated.

An extracting portion in the related art may be attached to and detached from the accommodating portion when an external force is applied by a user. A gap may be formed between the extracting portion and a housing of the aerosol generating device, and external air may be introduced through the gap. Accordingly, an airflow path for generating the aerosol may become unstable, and therefore, the flavor of the aerosol may not be consistent.

In addition, residues of the aerosol generating article may be introduced through the gap between the extracting portion and the housing. Inflow of the residues may decrease function of components in the aerosol generating device or cause damage to the device.

Solution to Problem

Embodiments provide an aerosol generating device including an extracting portion that is displaced according to movement of a cover portion.

The technical problems to be achieved the present embodiments are not limited to the above-described technical problems, and other technical problems may be derived from the following embodiments.

Advantageous Effects of Invention

Embodiments provide an aerosol generating device including an extracting portion that is displaced according to movement of a cover portion. According to movement of the cover portion, the extracting portion may move from a first position to a second position. According to movement of the extracting portion, the extracting portion may closely contact with a housing and prevent a gap from being formed between the extracting portion and the housing.

Close contact between the extracting portion and an upper housing may prevent introduction of external air between the extracting portion and the housing. As a result, an air flow path for generating aerosol may be stably maintained, and the consistency of the generated aerosol may be improved.

In addition, close contact between the extracting portion and the housing may prevent introduction of residues of the aerosol generating article through the gap between the extracting portion and the housing. As a result, damage to internal components of the aerosol generating device may be prevented, and durability of the aerosol generating device may be improved.

BRIEF DESCRIPTION OF DRAWINGS

FIG. 1 is a cross-sectional view of an aerosol generating device and an aerosol generating article, according to an embodiment;

FIG. 2A is a partial cross-sectional view of a cover portion of the aerosol generating device shown in FIG. 1;

FIG. 2B is another partial cross-sectional view of the cover portion of the aerosol generating device shown in FIG. 1;

FIGS. 3A and 3B are front views of a displacement mechanism according to an embodiment; and FIGS. 4A and 4B are perspective views of a displacement mechanism according to another embodiment.

BEST MODE FOR CARRYING OUT THE INVENTION

An aerosol generating device may include an accommodating portion configured to accommodate an aerosol generating article via an opening formed in an upper housing; a cover portion configured to open and close the opening; and an extracting portion arranged in the accommodating portion and configured to extract the aerosol generating article by moving from a first position to a second position in a longitudinal direction of the accommodating portion when the cover portion opens the opening.

The extracting portion may move from the second position to the first position when the cover portion closes the opening.

The cover portion includes a bottom surface portion adjacent to the extracting portion, and the bottom surface portion may contact with a portion of the upper housing when the cover portion closes the opening.

The extracting portion includes a top surface portion facing the upper housing, and the upper housing may be apart from the portion of the upper housing when the extracting portion is at the first position and contact with the portion of the upper housing when the extracting portion is at the second position.

The top surface portion may include a jaw portion protruding in a radial direction from an outer surface of the extracting portion.

The jaw portion may contact with the portion of the upper housing and the bottom surface portion when the extracting portion is at the second position.

When the extracting portion is at the second position, the top surface portion and the bottom surface portion may be at a same height with respect to the aerosol generating device.

When the extracting portion is at the second position, the top surface portion may contact with the portion of the upper housing and the bottom surface portion, and the contact may prevent introduction of external air between the top surface portion and the portion and between the top surface portion and the bottom surface portion.

The aerosol generating device may further include a connecting portion contacting with the cover portion and the extracting portion and displacing the extracting portion according to the movement of the cover portion.

The connecting portion may displace the extracting portion from the first position to the second position when the cover portion opens the opening and displace the extracting portion from the second position to the first position when the cover portion closes the opening.

An end portion of the connecting portion contacting with the extracting portion may displace the extracting portion by moving in a direction crossing with a direction in which the cover portion moves.

The connecting portion may include a first fixing portion configured to maintain the cover portion at a position that closes the opening; and a second fixing portion configured to maintain the cover portion at a position that opens the opening.

The connecting portion may rotate with respect to an axis extending in a longitudinal direction of the connecting portion when the cover portion moves.

The connecting portion includes, at its end portion, a cam portion contacting with the extracting portion, and the cam portion may displace the extracting portion according to rotation of the connecting portion.

MODE FOR THE INVENTION

With respect to the terms used to describe the embodiments, general terms which are currently and widely used are selected in consideration of functions of structural elements in the various embodiments of the present disclosure. However, meanings of the terms may be changed according to intention of one or ordinary skill in the art, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood as implication of the inclusion of stated elements but not the exclusion of any other elements. In addition, the terms "-er", "-or" and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression. "at least one of a, b, and c," should be understood as including only a, only b, only c, both a and b, both a and c, both b and c, or all of a, b, and c.

It will be understood that when an element or layer is referred to as being "over," "above," "on." "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Terms used in the present specification are not used for limiting embodiments but for describing the embodiments. In the specification, unless specifically mentioned in the context, singular forms also include plural forms.

Throughout the specification, "a longitudinal direction of a component" may be a lengthwise direction of the component in which the component extends longer than in any other directions crossing the lengthwise direction.

Hereinafter, the inventive concept will now be described more fully with reference to the accompanying drawings, such that one of ordinary skill in the art may easily practice the inventive concept. The inventive concept may, however, be embodied in many different forms and should not be construed as being limited to the embodiments set forth herein.

FIG. 1 is a cross-sectional view of an aerosol generating device 100 and an aerosol generating article 200 regarding embodiments.

An aerosol generating device 100 may include an accommodating portion 110 accommodating an aerosol generating article 200 (e.g., a cigarette) via an opening 115 formed in an upper housing 105, a cover portion 120 configured to open and close the opening 115, an extracting portion 130 mounted in the accommodating portion 110 and contacting with the aerosol generating article 200. The extracting portion 130 may extract the aerosol generating article 200 by moving in a longitudinal direction of the accommodating portion 110. The extracting portion may be moved from a first position to a second position as the cover portion 120 opens the opening 115.

The aerosol generating device 100 may include the accommodating portion 110 accommodating the aerosol generating article 200 through the opening 115 and the cover portion 120 configured to open and close the opening 115.

The opening 115 may be formed at one side of the accommodating portion 110. The aerosol generating article 200 may be inserted into the accommodating portion 110 through the opening 115. The opening 115 and the accommodating portion 110 may have shapes and sizes corresponding to those of the aerosol generating article 200 to accommodate the aerosol generating article 200.

For example, the aerosol generating article 200 has a cylindrical shape, and the accommodating portion 110 may also have a cylinder-shaped cavity to accommodate the aerosol generating article 200. However, a shape of the aerosol generating article 20X and shapes of the opening 115 and the accommodating portion 110 corresponding thereto are not limited thereto and may differ according to embodiments.

The aerosol generating device 100 may include the cover portion 120 configured to open and close the opening 115 formed in the upper housing 105 of the aerosol generating device 100. The cover portion 120 may allow the aerosol generating article 200 to be accommodated in the accommodating portion 110 through the opening 115 by opening the opening 115. By closing the opening 115, the cover portion 120 may also prevent foreign materials from being inserted into the accommodating portion 110 and protect an inner portion of the accommodating portion 110 from damage.

For example, the cover portion 120 may open and close the opening 115 by sliding. For example, the cover 120 may open the opening 115 by sliding away from the opening 115. After opening the opening 115, the cover portion 120 may close the opening 115 by sliding toward the opening 115. In this case, a sliding direction may be a direction crossing a longitudinal direction of the accommodating portion 110.

As another example, the cover portion 120 may open and close the opening 115 by hinge motion. A hinge structure (not shown) may be formed between the housing 105 and the cover portion 120 of the aerosol generating device 100. The cover portion 120 may open and close the opening 115 by swinging on the hinge structure. However, a method in which the cover portion 120 opens and closes the opening 115 is not limited and may be modified according to embodiments.

The aerosol generating device 100 may include the extracting portion 130 that is detachably mounted in the accommodating portion 110. The extracting portion 130 may extract the aerosol generating article 200 by moving in the longitudinal direction of the accommodating portion 110 while contacting with the aerosol generating article 200.

A cavity may be formed in the extracting portion 130. The cavity formed in the extracting portion 130 may have a size and a shape corresponding to those of the aerosol generating article 200 that is inserted into the extracting portion 130. For example, the aerosol generating article 200 and the cavity may have a cylindrical shape.

The extracting portion 130 may be attached to and detached from the aerosol generating device 100. As an example, the extracting portion 130 may extract the aerosol generating article 200 by being separated from the aerosol generating device 100. As another example, the extracting portion 130 may extract the aerosol generating article 200 by moving a preset distance in the accommodating portion 110 of the aerosol generating device 100.

Components of the aerosol generating device 100 are not limited to components shown in FIG. 1, and additional components may be further included according to embodiments.

For example, the aerosol generating device 100 regarding the embodiments may include a heater (not shown) configured to heat the aerosol generating article 200. The heater may be arranged near the accommodating portion 110. Heat of the heater may be delivered to the accommodating portion 110 and heat the aerosol generating article 200.

The heater of the aerosol generating device 100 may be, for example, an electro-resistive heater. The heater may include an electro-conductive track, and the heater may be heated as a current flows through the electro-conductive track. However, the heater is not limited the above-described example and may correspond to any heater that may be heated to a desired temperature. Here, the desired temperature may be preset in the aerosol generating device 100 or may be set as a desired temperature by the user.

As another example, the heater may include an induction heater. In detail, the heater may include an electrically conductive coil for heating the aerosol generating article 200 an induction heating method, and the aerosol generating article 200 may include a susceptor which may be heated by the induction heater.

The aerosol generating device 100 may further include a battery 101 which supplies power to the heater. The aerosol generating device 100 regarding an embodiment may receive power from the battery 101 and heat the aerosol generating article 200.

The battery 101 supplies power to be used for the aerosol generating device 100 to operate. For example, the battery 101 may supply power such that the heater may be heated. In addition, the battery 101 may supply power for operations of a display, a sensor, a motor, and the like that may be mounted in the aerosol generating device 100.

The aerosol generating device 100 may include a controller 102. The controller 102 generally controls operations of the aerosol generating device 100. In detail, the controller 102 controls operations of other configurations included in the aerosol generating device 100 in addition to the battery 101, and may check condition of each configuration of the aerosol generating device 1M and determine whether the aerosol generating device 100 may be operated.

The aerosol generating material 200 inserted into the aerosol generating device 100 may include a shredded-tobacco portion (not shown) including shredded tobacco, and a base portion (not shown) including an aerosol generating material. The shredded tobacco may include nicotine. The shredded-tobacco portion may be variously manufactured, for example, the shredded-tobacco portion may be manufactured as a sheet or a strand. The shredded-tobacco portion may be manufactured as fragments finely cut from a tobacco sheet. The base portion may be arranged adjacent to the shredded-tobacco portion. The aerosol generating material included in the base portion may be at least one of glycerin, propylene glycol, ethylene glycol, dipropylene glycol, diethylene glycol, triethylene glycol, tetraethylene glycol, and oleyl alcohol, but is not limited thereto.

FIG. 2A is a partial cross-sectional view of the cover portion 120 of the aerosol generating device 100 shown in FIG. 1. FIG. 2B is another partial cross-sectional view of the cover portion 120 of the aerosol generating device 100 shown in FIG. 1.

Referring to FIGS. 2A and 2B, displacement of the extracting portion 130 according to movement of the cover portion 120 will be described in more detail.

The extracting portion 130 of the aerosol generating device 100 may move from the first position to the second position when the cover portion 120 opens the opening 115, and may move from the second position to the first position when the cover portion 120 closes the opening 115.

The cover portion 120 may move, for example, from the position at which the opening 115 is closed, as shown in FIG. 2A, to the position at which the opening 115 is open, as shown in FIG. 2B. In addition, the cover portion 120 may move, for example, from the position at which the opening 115 is open as shown in FIG. 2B to the position at which the opening 115 is closed as shown in FIG. 2A. The cover portion 120 may open or close the opening by the external force of the user.

When the cover portion 120 opens the opening 115, the extracting portion 130 may move, for example, from the first position shown in FIG. 2A to the second position shown in FIG. 2B. In addition, when the cover portion 120 closes the opening 115, the extracting portion 130 may move, for example, from the second position shown in FIG. 2B to the first position shown in FIG. 2A. The first position and the second position are not limited to the drawings and may be modified according to embodiments.

The first position of the extracting portion 130 may be a position when the opening is covered by the cover portion 120, and the second position of the extracting portion 130 may be a position when the opening 115 is uncovered.

Compared to the first position, the second position may be closer to the upper housing 105 of the aerosol generating device 100. That is, when the cover portion 120 opens the opening 115, the extracting portion 130 may be displaced to be more adjacent to the upper housing 105, and when the cover portion 120 closes the opening 115, the extracting portion 130 may be displaced to be more distant from the upper housing 105.

The cover portion 120 of the aerosol generating device 100 may include a bottom surface portion 125 adjacent to the extracting portion 130. The bottom surface portion 125 of the cover portion 120 may be arranged at a position adjacent to the extracting portion 130 and may contact with a portion 1051 of the upper housing 105 when the cover portion 120 closes the opening 115. The bottom surface portion 125 of the cover portion 120 may contact with the portion 1051 of the upper housing 105 when the opening 115 is closed.

The extracting portion 130 of the aerosol generating device 100 may include a top surface portion 131 facing the upper housing 105. The top surface portion 131 may be apart from the portion 1051 of the upper housing 105 when the extracting portion 130 is at the first position as shown in FIG. 2A, and may contact with the portion 1051 of the upper housing 105 when the extracting portion 130 is at the second position as shown in FIG. 2B.

The top surface portion 131 may be an end portion of the extracting portion 130, which faces the upper housing 105 of the aerosol generating device 100. When the extracting portion 130 is at the first position, the top surface portion 131 of the extracting portion 130 may be apart from the portion 1051 of the upper housing 105, as shown in FIG. 2A. That is, when the cover portion 120 closes the opening 115 (i.e., when the extracting portion 130 is at the first position), the top surface portion 131 of the extracting unit 130 and the portion 1051 of the upper housing 105 may be apart from each other.

On the other hand, when the cover portion 120 opens the opening 115 (i.e., when the extracting portion 130 is at the second position), the top surface portion 131 of the extracting portion 130 may contact with the portion 1051 of the upper housing 105. In other words, the top surface portion 131 of the extracting portion 130 and the portion 1051 of the upper housing 105 may contact with each other when the extracting portion 130 is at the second position.

That is, when the cover portion 120 moves from the position at which the opening 115 closed to the position at which the opening 115 is open, the extracting portion 130 may move from the first position, at which the top surface portion 131 is apart from the upper housing 105, to the second position at which the top surface portion 131 contacts with the upper housing 105. According to movement of the extracting portion 130, the extracting portion 130 may closely contact with the upper housing 105. The contact between the extracting portion 130 and the upper housing 105 may prevent a gap between the extracting portion 130 and the upper housing 105 while the opening 115 is open.

Close contact between the extracting portion 130 and the upper housing 105 may prevent external air being introduced between the extracting portion 130 and the upper housing 105. As a result, an air flow path for generating aerosol may be stably maintained, and the consistency of the generated aerosol may be improved.

In addition, close contact between the extracting portion 130 and the housing 105 may prevent instruction of residues of the aerosol generating article 200 through a gap between the extracting portion 130 and the housing 105. As introduction of the residues is prevented, damage to internal components of the aerosol generating device 100 may be prevented, and durability of the aerosol generating device 100 may be improved.

The top surface portion 131 of the extracting portion 131 may include a jaw portion 132 protruding in a radial direction from an outer surface of the extracting portion. The jaw portion 132 may extend by a preset distance in the radial direction from an outer surface of an end portion of the extracting portion 130.

As shown in FIG. 2B, when the extracting portion 130 is at the second position (i.e., when the opening 115 is open), the jaw portion 132 may contact with the portion 1051 of the upper housing 105 and the bottom surface portion 125 of the cover portion 120. Contact between the jaw portion 132 and the portion 1051 of the upper housing 105 and contact between the jaw portion 132 and the bottom surface portion 132 may be tight such that there is no gap between the extracting portion 130 and the housing 105 or between the extracting portion 130 and the cover portion 120.

When the extracting portion 130 is at the second position, the top surface portion 131 of the extracting portion 130 and the bottom surface portion 125 of the cover portion 120 may be located at the substantially same height with respect to the aerosol generating device 100. When the extracting portion 130 moves from the first position to the second position, the extracting portion 130 may be moved closer to the upper housing 105 of the aerosol generating device 100. In this case, as shown in FIG. 2B, the top surface portion 131 of the extracting portion 130 and the bottom surface portion 125 of the cover portion 120 may be located at the substantially same height.

When the extracting portion 130 is at the second position, the top surface portion 131 of the extracting portion 130 may contact with the portion 1051 of the upper housing 105 and the bottom surface portion 125. Contact between the top surface portion 131 and the portion 1051 and contact between the top surface portion 131 and the bottom surface portion 125 may prevent introduction of external air between the top surface 131 and the portion 1051 and between the top surface portion 131 and the bottom surface portion 125.

FIGS. 3A and 3B are front views of an example of a displacement mechanism according to an embodiment.

The aerosol generating device 100 may include a connecting portion 135*a* which contacts with the cover portion 120 and the extracting portion 130 such that the extracting portion 130 may be displaced according to movement of the cover portion 120. The connecting portion 135*a* may displace the extracting portion 130 from the first position to the second position when the cover portion 120 opens the opening 115. In addition, the connecting portion 135*a* may displace the extracting unit 130 from the second position to the first position when the cover portion 120 closes the opening 115.

An end portion of the connecting portion 135*a* may contact with the extracting portion 130. The end portion of the connecting portion 135*a* may displace the extracting portion 130 by moving in a direction crossing a direction in which the cover portion 120 moves. For example, as shown in FIG. 3B, when the cover portion 120 opens the opening 115 by sliding to the right, the end portion of the connecting portion 135*a* may move upward (i.e., in a direction crossing a direction in which the cover portion 120 slides).

For example, the connecting portion 135*a* may have a lever shape. The connecting portion 135*a* may rotate by a certain degree with respect to a preset portion such that the end portion 135*a* contacting with the extracting portion 130 may ascend or descend.

The connecting portion 135*a* may rotate according to movement of the cover portion 120. That is, when the cover portion 120 moves, the connecting portion 135*a* may rotate by a certain degree with respect to the preset portion, and the rotation of the connecting portion 135*a* may make the extracting portion 130 ascend or descend.

When the cover portion 120 slides in the direction to open the opening 115, the end portion of the connecting portion 135*a* may ascend. As the end portion of the connecting portion 135*a* ascends, the extracting portion 130 may be displaced from the first position to the second position. When the cover portion 120 slides in a direction to close the opening 115, the end portion of the connecting portion 135*a* may descend. As the end portion of the connecting portion 135*a* descends, the extracting portion 130 may be displaced from the second position to the first position.

The connecting portion 135*a* may include a first fixing portion 1351 configured to maintain the cover portion 120 at the position that closes the opening 115; and a second fixing portion 1352 configured to maintain the cover portion 120 at the position that opens the opening 115.

The first fixing portion 1351 may protrude to contact with the cover portion 120 when the cover portion 120 closes the opening 115, as shown in FIG. 3A. The first fixing portion 1351 may press the cover portion 120 such that the cover portion 120 is maintained at the position that closes the opening 115.

The second fixing portion 1352 may protrude to contact with the cover portion 120 when the cover portion 120 is at the position to open the opening 115, as shown in FIG. 3B. The second fixing portion 1352 may press the cover portion 120 such that the cover portion 120 is maintained at the position that opens the opening 115.

FIGS. 4A and 4B are perspective views of a displacement mechanism according to another embodiment.

As shown in FIG. 4A, the connecting portion 135*b* may rotate with respect to an axis in a longitudinal direction of the connecting portion 135*b* when the cover portion 120 moves. The connecting portion 135*b*, at its end portion, includes a cam portion 1353 contacting with the extracting portion 130, and the cam portion 1353 may displace the extracting portion 130 according to rotation of the connecting portion 135*b*.

A height of the cam portion 1353 contacting with the extracting portion 130 may be changed according to rotation of the connecting portion 135*b*. A thickness of the cam portion 1353 may linearly increase, and the cam portion 1353 may contact with the extracting portion 130 without causing damage to the extracting portion 130.

Sliding of the cover portion 120 may have the connecting portion 135*b* rotate with reference to an axis of the longitudinal direction of the connecting portion 135*b*. For example, the connecting portion 135*b* may rotate according to sliding of the cover portion 120 by engagement of a sloped portion 121 of the cover portion 120 and a protrusion portion 1354 of the connecting portion 135*b*. However, a rotation method of the connecting portion 135*b* according to movement of the cover portion 120 is not limited thereto and may be changed according to embodiments.

A part of the cam portion 1353 which has the greatest thickness may contact with the extracting portion 130 when the connecting portion 135*b* rotates to open the opening 115, as shown in FIG. 4B. In other words, when the thickest pan of the cam portion 1353 contacts with the extracting portion 130, the extracting portion 130 contacting with the cam portion 1353 may be at the second position.

In addition, a part of the cam portion 1353 which has the smallest thickness may contact with the extracting portion 130 when the cover portion 120 closes the opening 115, as shown in FIG. 4A. In other words, when a part of the cam portion 1353 which has the smallest thickness contacts with the extracting portion 130, the extracting portion 130 contacting with the cam portion 1353 may be at the first position.

That is, when the cover portion 120 slides from the position that closes the opening 115 to the position that opens the opening 115, the connecting portion 135*b* may rotate with respect to the axis in the longitudinal direction of the connecting portion 135*b* such that a part of the cam portion 1353 contacting with the extracting portion 130 may have a greatest thickness. Accordingly, the connecting portion 135*b* may displace the extracting portion 130 from the first position to the second position.

In addition, when the cover portion 120 slide from the position that opens the opening 115 to the position that closes the opening 115, the connecting portion 135*b* may rotate with reference to the axis in the longitudinal direction of the connecting portion 135*b* such that a part of the cam portion 1353 contacting with the extracting portion 130 may have a smallest thickness. Accordingly, the connecting portion 135*b* may displace the extracting portion 130 from the second position to the first position.

Embodiments provide the aerosol generating device 100 including the extracting portion 130 displaced according to movement of the cover portion 120. According to movement of the cover portion 120, the extracting portion 130 may move from the first place to the second place. Movement of the extracting portion 130 according to movement of the cover portion 120 may allow close contact between the extracting portion 130 and the housing 105 when the user moves the cover portion 120, which prevents a gap from being formed between the extracting portion 130 and the housing 105.

As a result, external air may be prevented from being introduced between the extracting portion 130 and the upper housing 105. Introduction of external air may make the air flow path in the aerosol generating device 100 unstable. In this respect, contact between the extracting portion 130 and the upper housing 105 in the aerosol generating device 100 according to the embodiments may stably maintain the air flow path for generating the aerosol, and improve the consistency of aerosol.

In addition, close contact between the extracting portion 130 and the housing 105 may prevent residues of the aerosol generating article 200 from being introduced through the gap between the extracting portion 130 and the housing 105. As a result, damage to the internal components of the aerosol generating device 100 may be prevented, and durability of the aerosol generating device 100 may be improved.

In technical fields related to the present embodiments, one of ordinary skill in the art may understand that the present disclosure may be embodied in modified forms in a scope within essential characteristics of the above description. The disclosed methods should be considered in a descriptive sense only and not for purposes of limitation. The scope of the present disclosure is not disclosed in the above description but in the following claims, and all differences within the scope equivalent thereof will be construed as being included in the present disclosure.

The invention claimed is:

1. An aerosol generating device comprising:

an accommodating portion configured to accommodate an aerosol generating article via an opening formed in an upper housing;

a cover portion configured to open and close the opening; and an extracting portion arranged in the accommodating portion and configured to extract the aerosol generating article by moving from a first position to a second position in a longitudinal direction of the accommodating portion when the cover portion opens the opening, wherein the cover portion comprises a bottom surface portion that contacts with a portion of the upper housing when the cover portion closes the opening, and wherein the extracting portion comprises a top surface portion facing the upper housing, and the top surface portion of the extracting portion is apart from the portion of the upper housing when the extracting portion is at the first position, and contacts with the portion of the upper housing such that a gap is prevented from being formed between the extracting portion and the upper housing when the extracting portion is at the second position.

2. The aerosol generating device of claim 1, wherein the extracting portion moves from the second position to the first position when the cover portion closes the opening.

3. The aerosol generating device of claim 1, wherein the top surface portion of the extracting portion comprises a jaw portion protruding in a radial direction from an outer surface of the extracting portion.

4. The aerosol generating device of claim 3, wherein the jaw portion contacts with the portion of the upper housing and the bottom surface portion of the cover portion when the extracting portion is at the second position.

5. The aerosol generating device of claim 1, wherein the top surface portion of the extracting portion and the bottom surface portion of the cover portion are located at a substantially same height with respect to the aerosol generating device when the extracting portion is at the second position.

6. The aerosol generating device of claim 5, wherein when the extracting portion is at the second position, the top surface portion of the extracting portion contacts with the portion of the upper housing and the bottom surface portion of the cover portion such that external air is prevented from being introduced between the top surface portion of the extracting portion and the portion of the upper housing and between the top surface portion and the bottom surface portion.

7. The aerosol generating device of claim 1, further comprising a connecting portion contacting with the cover portion and the extracting portion, and configured to displace the extracting portion according to movement of the cover portion.

8. The aerosol generating device of claim 7, wherein the connecting portion is configured to displace the extracting portion from the first position to the second position when the cover portion opens the opening, and displace the extracting portion from the second position to the first position when the cover portion closes the opening.

9. The aerosol generating device of claim 8, wherein an end portion of the connecting portion contacting with the extracting portion is configured to move in a direction crossing a direction in which the cover portion moves.

10. The aerosol generating device of claim 9, wherein the connecting portion comprises:

a first fixing portion configured to maintain the cover portion at a position that closes the opening; and a second fixing portion configured to maintain the cover portion at the position that opens the opening.

11. The aerosol generating device of claim 7, wherein the connecting portion is configured to rotate with respect to an axis extending in a longitudinal direction of the connecting portion when the cover portion moves.

12. The aerosol generating device of claim 11, wherein the connecting portion comprises a cam portion contacting with the extracting portion, and configured to displace the extracting portion according to rotation of the connecting portion.

* * * * *